US006948704B2

(12) United States Patent
Forbis et al.

(10) Patent No.: US 6,948,704 B2
(45) Date of Patent: Sep. 27, 2005

(54) BRACKET ASSEMBLY FOR CONNECTING RAILS OF VARIOUS CONFIGURATIONS TO A SUPPORT STRUCTURE

(75) Inventors: John T. Forbis, York, NE (US); Randy R. Quaintance, York, NE (US)

(73) Assignee: Kroy Building Products, Inc., Cary, NC (US)

( * ) Notice: Subject to any disclaimer, the term of this patent is extended or adjusted under 35 U.S.C. 154(b) by 0 days.

(21) Appl. No.: 10/361,150

(22) Filed: Feb. 5, 2003

(65) Prior Publication Data

US 2003/0222258 A1 Dec. 4, 2003

Related U.S. Application Data

(60) Provisional application No. 60/440,307, filed on Jan. 13, 2003, and provisional application No. 60/355,382, filed on Feb. 6, 2002.

(51) Int. Cl.[7] ..... E04H 17/14
(52) U.S. Cl. ..... 256/65.08
(58) Field of Search ..... 256/59, 65.01–65.06, 256/67, 65.08; 248/219.3–219, 251, 314

(56) References Cited

U.S. PATENT DOCUMENTS

| | | | |
|---|---|---|---|
| 2,336,385 | A | 12/1943 | Batcheller |
| 2,590,929 | A | 4/1952 | Bush |
| 3,107,900 | A | 10/1963 | de Paolo |
| 3,156,282 | A | 11/1964 | Bedford, Jr. |
| 3,208,778 | A | 9/1965 | Gordon |
| 3,212,754 | A | 10/1965 | Revell et al. |
| 3,278,149 | A | 10/1966 | Brucker |
| 3,385,567 | A | 5/1968 | Case et al. |
| 3,498,589 | A | 3/1970 | Murdock |
| 3,506,243 | A | 4/1970 | Seiler |
| 4,101,226 | A | 7/1978 | Parisien |
| 4,114,861 | A | 9/1978 | Long |
| 4,124,198 | A | 11/1978 | Wong |
| 4,135,837 | A | 1/1979 | Suttles |
| 4,165,944 | A | 8/1979 | Sunasky |
| 4,280,686 | A | 7/1981 | Wack |
| 4,368,875 | A | 1/1983 | Weiss et al. |
| 4,369,953 | A | 1/1983 | Greiner et al. |
| 4,616,950 | A | 10/1986 | Morris |
| 4,625,948 | A | 12/1986 | Lustvee |
| 4,856,252 | A | 8/1989 | Cornell |
| 4,919,394 | A | 4/1990 | Otte et al. |
| 4,923,176 | A | 5/1990 | Heinz |
| 4,958,399 | A | 9/1990 | Toal et al. |
| 5,101,540 | A | 4/1992 | Roof et al. |
| 5,143,472 | A | 9/1992 | Reed et al. |
| 5,186,571 | A | 2/1993 | Hentzschel |
| 5,215,290 | A | 6/1993 | Khalessi |
| 5,437,433 | A | 8/1995 | Rezek |
| 5,441,241 | A | 8/1995 | McKim |

(Continued)

FOREIGN PATENT DOCUMENTS

| | | |
|---|---|---|
| CA | 1035983 | 8/1978 |
| DE | 3404-947 A | 8/1985 |
| GB | 29939 | 10/1898 |

*Primary Examiner*—John R. Cottingham
(74) *Attorney, Agent, or Firm*—Clayton, Howarth & Cannon, P.C.

(57) ABSTRACT

A bracket assembly for attaching rails of multiple configurations to a support structure. The bracket assembly may include a base piece having a plate with a pair of flanges extending substantially perpendicularly therefrom. An insert may be configured to fit between the flanges and within the rail to provide support to the rail. A pin may be inserted through openings in the flanges, the insert, and the rail to attach the rail to the insert and the base piece. A cover may be placed over the base piece to provide a pleasing appearance to the bracket assembly. A single sized base piece, insert, and pin may be used to connect rails of different sizes and shapes to the support structure.

50 Claims, 8 Drawing Sheets

U.S. PATENT DOCUMENTS 5,474,279 A 12/1995 Parisien
5,544,865 A 8/1996 Abbaticchio
5,547,169 A 8/1996 Russell
5,564,248 A 10/1996 Callies
5,755,431 A 5/1998 Williams
5,788,224 A 8/1998 Platt
5,795,503 A 8/1998 Krake
5,873,671 A 2/1999 West
5,938,184 A 8/1999 DeSouza
5,964,452 A 10/1999 Summers
5,967,498 A 10/1999 Junell
5,971,365 A 10/1999 Pigott et al.
6,017,019 A 1/2000 Erwin
6,029,954 A 2/2000 Murdaca
6,039,307 A 3/2000 De Zen
6,053,481 A 4/2000 Scheide
6,131,358 A 10/2000 Wise
6,173,944 B1 1/2001 McCarthy
6,308,937 B1 10/2001 Pettit
6,398,193 B1 6/2002 DeSouza
6,698,726 B2 * 3/2004 Platt ..... 256/59

* cited by examiner

BRACKET ASSEMBLY FOR CONNECTING RAILS OF VARIOUS CONFIGURATIONS TO A SUPPORT STRUCTURE

CROSS-REFERENCE TO RELATED APPLICATIONS

This application claims the benefit of U.S. Provisional Application No. 60/440,307, filed Jan. 13, 2003, and U.S. Provisional Application No. 60/355,382, filed Feb. 6, 2002, which applications are hereby incorporated by reference herein in their entireties, including but not limited to those portions that specifically appear hereinafter, the incorporation by reference being made with the following exception: In the event that any portion of the above-referenced provisional applications are inconsistent with this application, this application supercedes said provisional applications.

STATEMENT REGARDING FEDERALLY SPONSORED RESEARCH OR DEVELOPMENT

Not Applicable.

BACKGROUND OF THE INVENTION

1. The Field of the Invention

The present invention relates generally to bracket assemblies, and more particularly, the present invention relates to a rail attachment bracket assembly used to secure a rail to a support structure such that rails of different configurations may be used with the same bracket.

2. Description of Related Art

Railings of various sizes and configurations are used to designate boundaries such as in fences for example, or to protect individuals from dangerous locations. Additionally, railings on stair cases and decks help to steady people and prevent accidental injury. In recent years, there has been a tremendous increase in the use of vinyl and similar products for constructing railings. The vinyl products have numerous advantages over the prior materials. For example, vinyl rails can be shaped in various configurations to provide a desired aesthetic appearance or strength. Vinyl is flexible and less prone to damage than wood and other prior materials. Vinyl is also mark resistant and does not require frequent repainting or staining to protect the fence or railing from the elements. Additionally, the vinyl products are usually cost competitive with the other materials. Because of these advantages, vinyl has become a material of choice for making fences and columns, as well as railings for decks and staircases.

While the vinyl products are highly desirable for such uses, the fact that the vinyl is typically formed into hollow rails or posts raises certain difficulties. Primarily, the lack of any center support makes vinyl rails and posts more difficult to attach to support structures, especially to other pieces of vinyl.

Various different bracket systems are known in the art to attach rails to support structures. For example, U.S. Pat. No. 5,873,671 (granted Feb. 23, 1999 to West) discloses a rail attachment bracket with a snap-on cover. The attachment bracket has a face plate having an integral support member extending away from the face plate for supporting a hollow rail. The integral support member is sized to accommodate a rail having a particular configuration. Rails having hollow openings that are too small are not able to fit around the support member. Rails having hollow openings that are too large allow movement of the rail with respect to the support member. Thus, a different sized attachment bracket is required for each different configuration of rail that is used.

Rail brackets used in most commercial applications must meet various strength and functional standards such as those established under the Building Officials and Code Administrators International, Inc. (BOCA), the Standard Building Code (SBC), or the International Conference of Building Officials (ICBO) for example. Furthermore, since many brackets are designed to attach only to rails of a specific design or shape, for each type of rail and bracket combination, considerable testing must be accomplished to ensure that the products meet the applicable standards. The testing required to meet the standard approval adds to the cost and complexity of producing the brackets. Furthermore, the complexity and cost of producing and storing brackets of various sizes and configurations increases with the number of different brackets that are required. Installation in the field is also more difficult when proper sizing of a bracket is required with a specific rail.

Thus, there is a need for an improved rail attachment bracket wherein the bracket can be used with rails having different configurations so that the bracket is more versatile and the cost of testing to meet applicable standards is reduced. The attachment bracket should also be inexpensive and easy to use. Additionally, the bracket should be concealed to provide a finished look to the railing.

The prior art is thus characterized by several disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
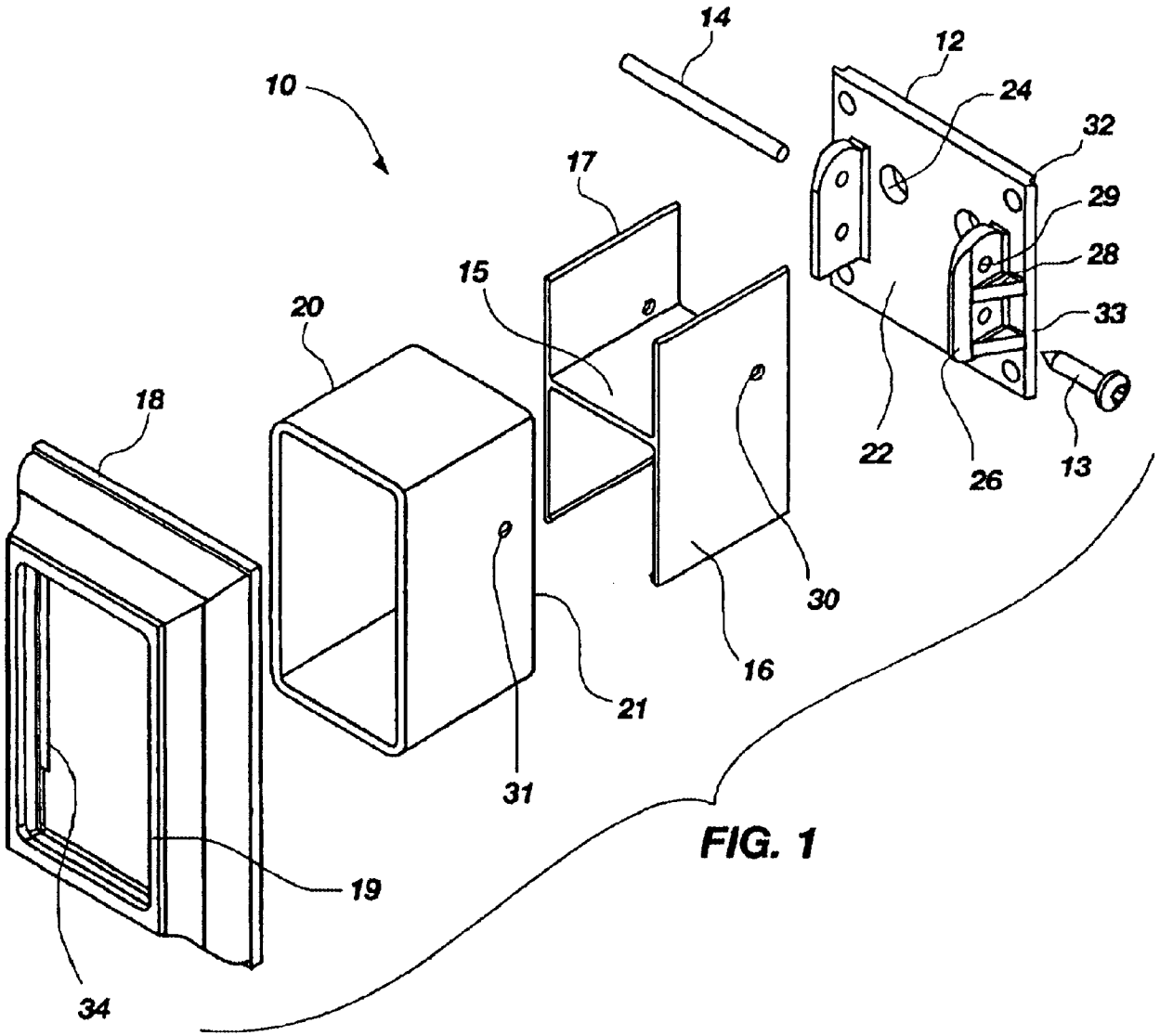
FIG. 1 is an exploded perspective view of a bracket assembly and rail in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise.

As used herein, "comprising," "including," "containing," "characterized by," and grammatical equivalents thereof are inclusive or open-ended terms that do not exclude additional, unrecited elements or method steps.

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

Figure 5:
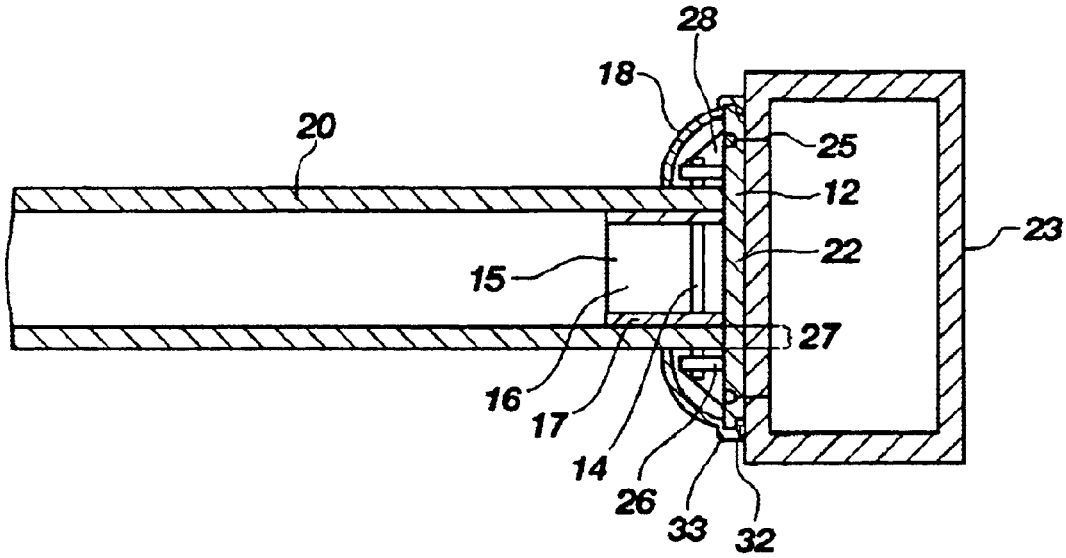
FIG. 5 is a break-away top view of a cross-section, taken along line A—A in FIG. 2*a*, of a rail and bracket assembly attached to a support structure.

Referring now to FIG. 1, an exploded perspective view of a bracket assembly, indicated generally at 10, and rail 20 is shown in accordance with the principles of the present invention. The bracket assembly 10, may include a base piece 12, a pin 14, an insert 16, and a cover 18, also sometimes referred to as a trim. Also shown in FIG. 1 is one embodiment of a rail 20 having a hollow open end 21. The rail 20 may be attached to a support structure 23, such as a post or wall as shown in FIG. 5, using the bracket assembly 10 in accordance with the principles of the present invention. It will be appreciated, as discussed more fully below, that the rail 20 may have various configurations within the scope of the present invention.

The base piece 12 may include a substantially planar plate 22 having means for attaching the base piece 12 to the support structure 23. In one embodiment of the present invention, the means for attaching the base piece 12 to the support structure 23 may include openings 24 in the plate 22 through which bracket fasteners 25 such as screws (see FIG. 5), bolts, or nails for example may be attached. It will be appreciated that the means for attaching the base piece 12 to the support structure 23 may include other structures such as clips, clamps, adhesives or welding for example, within the scope of the present invention.

The base piece 12 also may include at least one flange 26 extending in a substantially perpendicular orientation from the plate 22. In one embodiment, a pair of flanges 26 may be spaced apart on the plate 22. The flanges 26 may include one or more supports 28 to help the flanges 26 sustain lateral loads placed upon them. The supports 28 may be oriented in a plane substantially perpendicular to the flanges 26 and also to the plate 22. Also, the flanges 26 may include one or more apertures 29 for receiving the pin 14 to secure the rail 20 to the base piece 12. The apertures 29 may be rounded or formed as slots to facilitate insertion of the pin 14.

The plate 22 may also include a groove 32 extending along back side edges of the plate 22. The groove 32 may be used for attaching the cover 18 to the base piece 12 as discussed more fully below. The plate 22 may also have tapered edges 33 adjacent to the groove 32 on a front side of the plate.

The pin 14 may have a round cross-section and a smooth surface, characterized by an absence of threads, to facilitate insertion into apertures 29, and may be dimensioned to extend across the flanges 26. It will be appreciated that the pin 14 may have various sizes and configurations within the scope of the present invention.

A rail fastener 13 may also be used in addition to the pin 14 to attach the rail 20 to the base piece 12. It will be appreciated that the rail fastener 13 may include a threaded screw or a nail for example, and may pass through a flange 26 on one or both sides of the base piece 12, as well as through the rail 20 and the insert 16. The rail fastener 13 may provide an additional attachment mechanism for the bracket assembly 10, and it will be appreciated that the bracket assembly 10 may be used without the rail fastener 13.

The insert 16 may be substantially "H" shaped to provide strength for supporting the rail 20. The insert 16 may include opposing side walls 17 separated by a connecting wall 15. However, it will be appreciated that the insert 16 may have other configurations within the scope of the present invention, such as a substantially "U" shape or rectangular shape for example. The insert 16 may also include apertures 30 in the side walls 17 for receiving the pin 14 to attach the insert 16 to the base piece 12. The insert 16 may be sized to fit inside the rail 20 so that the rail 20 resides between the flanges 26 and the insert 16 as shown most clearly in FIG. 5. Thus, the bracket assembly 10 may define a space 27 between the flanges 26 and the insert 16 for receiving the rail 20. The insert 16 provides strength to the bracket assembly 10 so that the rail 20 may be adequately supported.

The cover 18 may be sized to receive the rail 20 and serve to conceal the base piece 12 to provide an aesthetically pleasing connection. The cover 18 may include a tab 34 which may be received in the groove 32 of the base piece 12 to attach the cover 18 to the base piece 12. The tab 34 may be made of a resilient material to allow the tab 34 to deflect when pressed against a solid object such as the tapered edge 33, and spring back to its relaxed position when the tab 34 enters into the groove 32. Such attachment of the tab 34 into the groove 32 may also be referred to herein as a snap-fit. The cover 18 may also be configured to allow the tab 34 to slide into the groove 32 without a snap-fit.

Figure 2A:
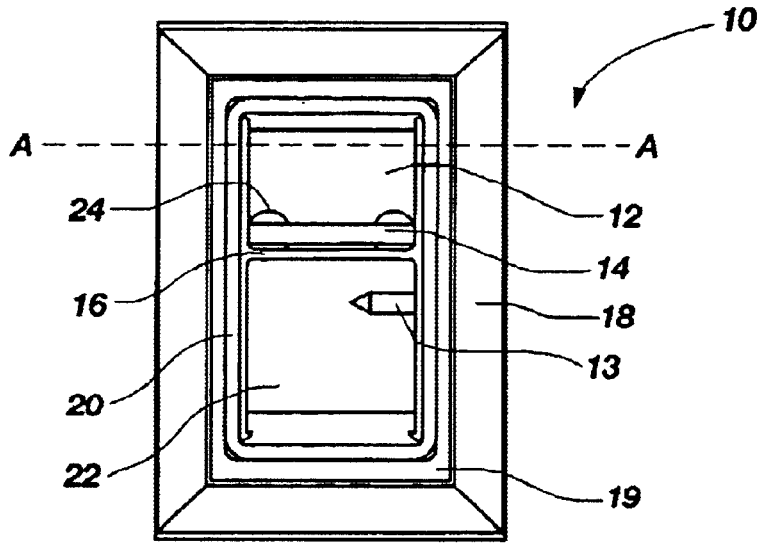
FIG. 2*a* is an end view of the bracket assembly and rail of FIG. 1.
Figure 2B:
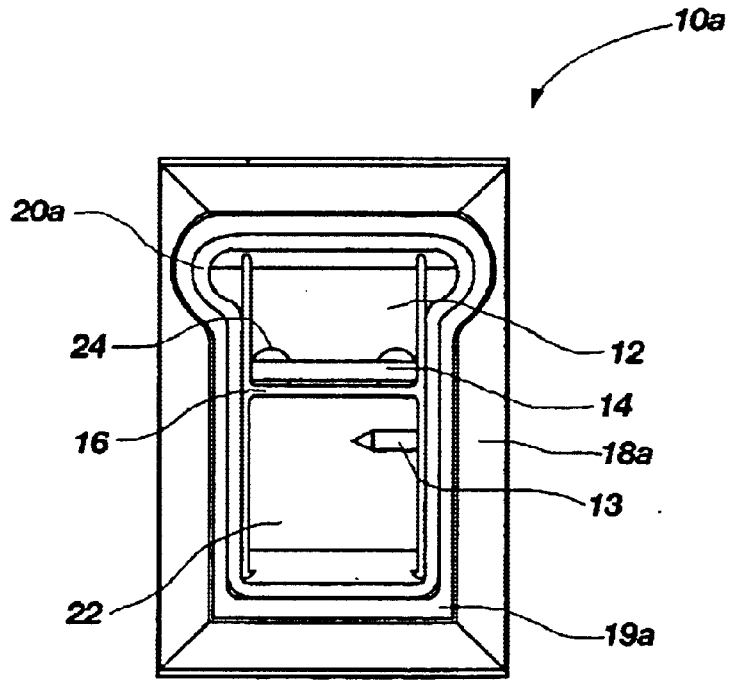
FIG. 2*b* is an end view of the bracket assembly and an alternate embodiment of the rail.

The cover 18 may define a perimeter 19 which corresponds to the exterior shape of the rail 20. As shown in FIGS. 1 and 2*a*, the perimeter 19 may be rectangular in shape to correspond with a rail 20 having a rectangular shaped cross section. However, covers 18 may be used for rails 20 having different exterior shapes, or rails 20 having different shaped cross sections may be used with a rectangular shaped cover 18. As shown in FIG. 2*b*, an alternative bracket assembly 10*a* may have a different shaped rail 20*a* and cover 18*a* with a non-rectangular perimeter 19*a*.

It will be appreciated that the bracket assembly 10 may be configured to support the rail 20 without the cover 18, but the cover 18 provides advantages of enhanced security since the cover 18 may cause the pin 14 and base piece 12 to not be readily accessible. Moreover, the cover 18 may be configured in various different decorative configurations to provide an aesthetically pleasing appearance.

The rail 20 may also include apertures 31 for receiving the pin 14 to attach the rail 20 to the insert 16 and the base piece 12. It will be appreciated that the rail 20 may have various configurations, such as substantially rectangular as shown in FIGS. 1 and 2*a*, or somewhat "T" or loaf shaped as shown in the alternate embodiments of the rail 20*a*, 20*b*, and 20*c* shown in FIGS. 2*b*, 3 and 4 respectively, or numerous other configurations.

The base piece 12, the pin 14, and the insert 16 may be made of a material having suitable strength and durability characteristics, such as metal for example. The cover 18 may be made of vinyl or other materials for example to match the material of the rail 20. The rail 20 may be made of various materials such as polyvinyl chloride (PVC), a composite of wood flour and PVC, a composite of wood flour and polyethylene, or pultruded fiberglass for example. However, it will be appreciated by those skilled in the art that other materials may be used to make the rail 20 and the components of the bracket assembly 10.

Assembly of the elements of one embodiment of the invention will now be discussed. The base piece 12 may be attached to the support structure 23 by inserting bracket fasteners 25 through the openings 24 and into the support structure 23. The insert 16 may be placed within the rail 20 so that the apertures 31 in the rail 20 are in alignment with the apertures 30 in the insert 16. The rail 20 may be placed between the flanges 26 so that the apertures 31 in the rail 20 and the apertures 30 in the insert 16 are in alignment with the apertures 29 in the flanges 26. The pin 14 may be inserted through the apertures 29 in the flanges 26, the apertures 31 in the rail 20, and the apertures 30 in the insert 16. A rail fastener 13 may also be inserted through one or more of the flanges 26, the insert 16 and the rail 20. The cover 18 may be placed over the rail 20 and the tabs 34 placed into the grooves 32 in a sliding or snap-fit arrangement.

Figure 3A:
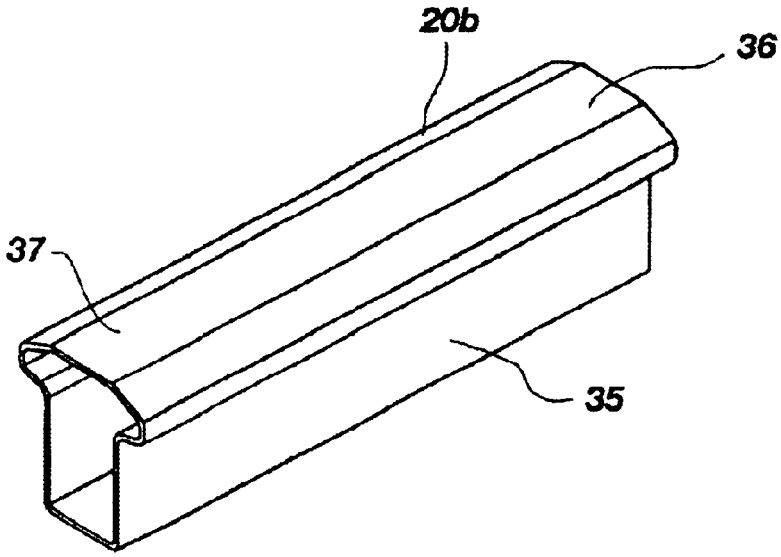
FIG. 3*a* is a perspective view of an exemplary alternative embodiment rail which may be used with the bracket assembly of the present invention.
Figure 3B:
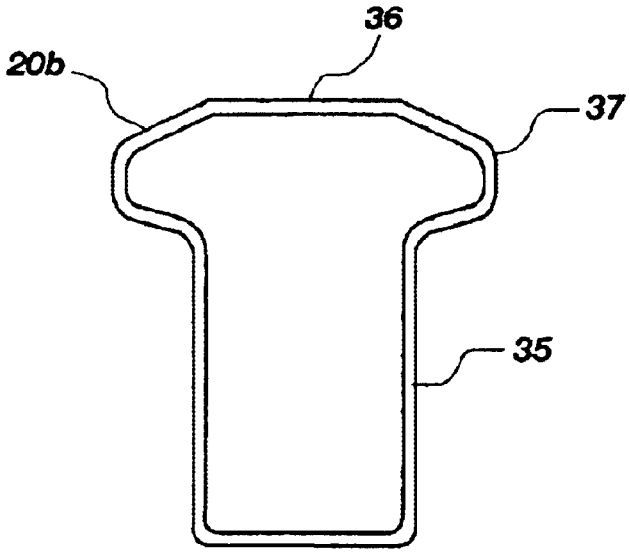
FIG. 3*b* is an end view of the rail of FIG. 3*a;*
Figure 4A:
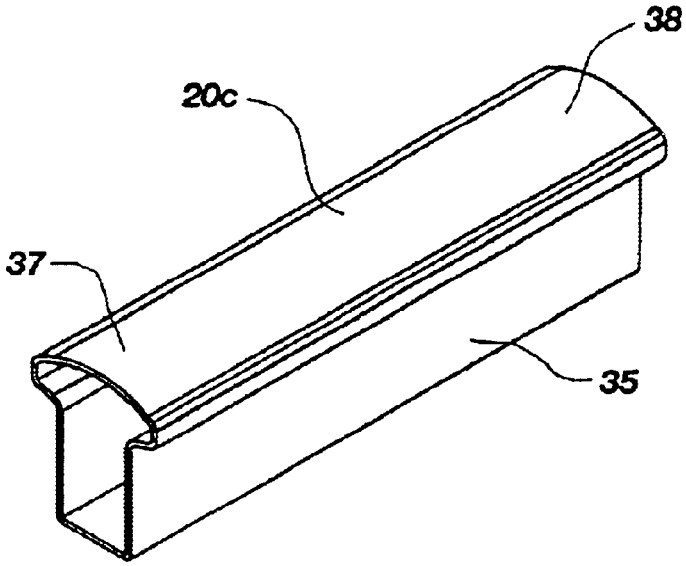
FIG. 4*a* is a perspective view of a further exemplary rail which may be used with the bracket assembly of the present invention.
Figure 4B:
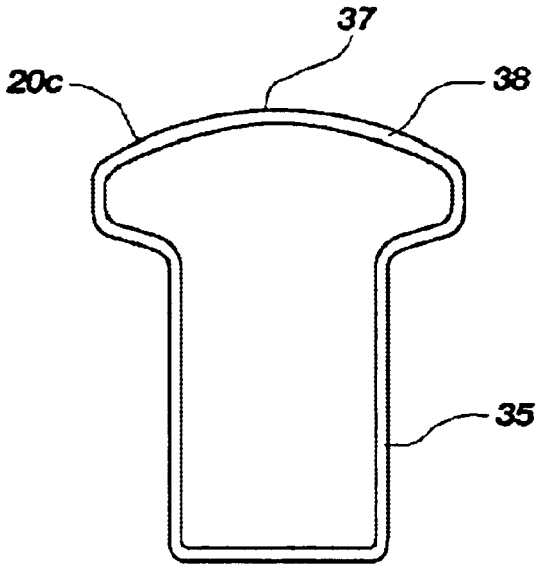
FIG. 4*b* is an end view of the rail of FIG. 4*a;*

It will be appreciated that a particular base piece 12, pin 14, and insert 16 may be used with rails 20 of different configurations. For example, the insert 16 may be configured to fit within either a rectangular rail 20 or a somewhat "T" shaped rail 20*b*, 20*c* as shown in FIGS. 3 and 4 respectively. The somewhat "T" shaped rails 20*b*, 20*c* may have a relatively narrow lower portion 35, and a relatively wide upper portion 37. Furthermore, the rails may have various dimensions that fit between the flanges 26. Therefore, rails having a multi-angular top portion 36 as shown in FIGS. 3*a* and 3*b*, or a rounded top portion 38 as shown in FIGS. 4*a* and 4*b*, may be attached to the support structure 23 using the same base piece 12, insert 16 and pin 14. This configuration of attachment assembly provides an advantage of providing flexibility to use the same bracket components with rails 20 having different shapes and designs. Furthermore, the bracket assembly 10 may be tested for strength and operational characteristics to meet the standards established, for example, under the Building Officials and Code Administrators International, Inc. (BOCA), the Standard Building Code (SBC), or the International Conference of Building Officials (ICBO). Thus, the present invention allows compliance with the applicable standards requirements without having to test multiple bracket assemblies for the various different rail configurations that may be used. This reduces the cost and complexity of manufacturing and preparing the bracket assembly 10 for market. The base piece 12, pin 14, and insert 16 may be configured so that minimum strength standards are met without the characteristics of the rail 20 being included. Thus, the strength contributions due to any rail 20 used may cause the bracket assembly 10 to exceed the strength standards even further, and additional testing is not required to demonstrate compliance with the strength standards even if different rails 20 are used.

Figure 6:
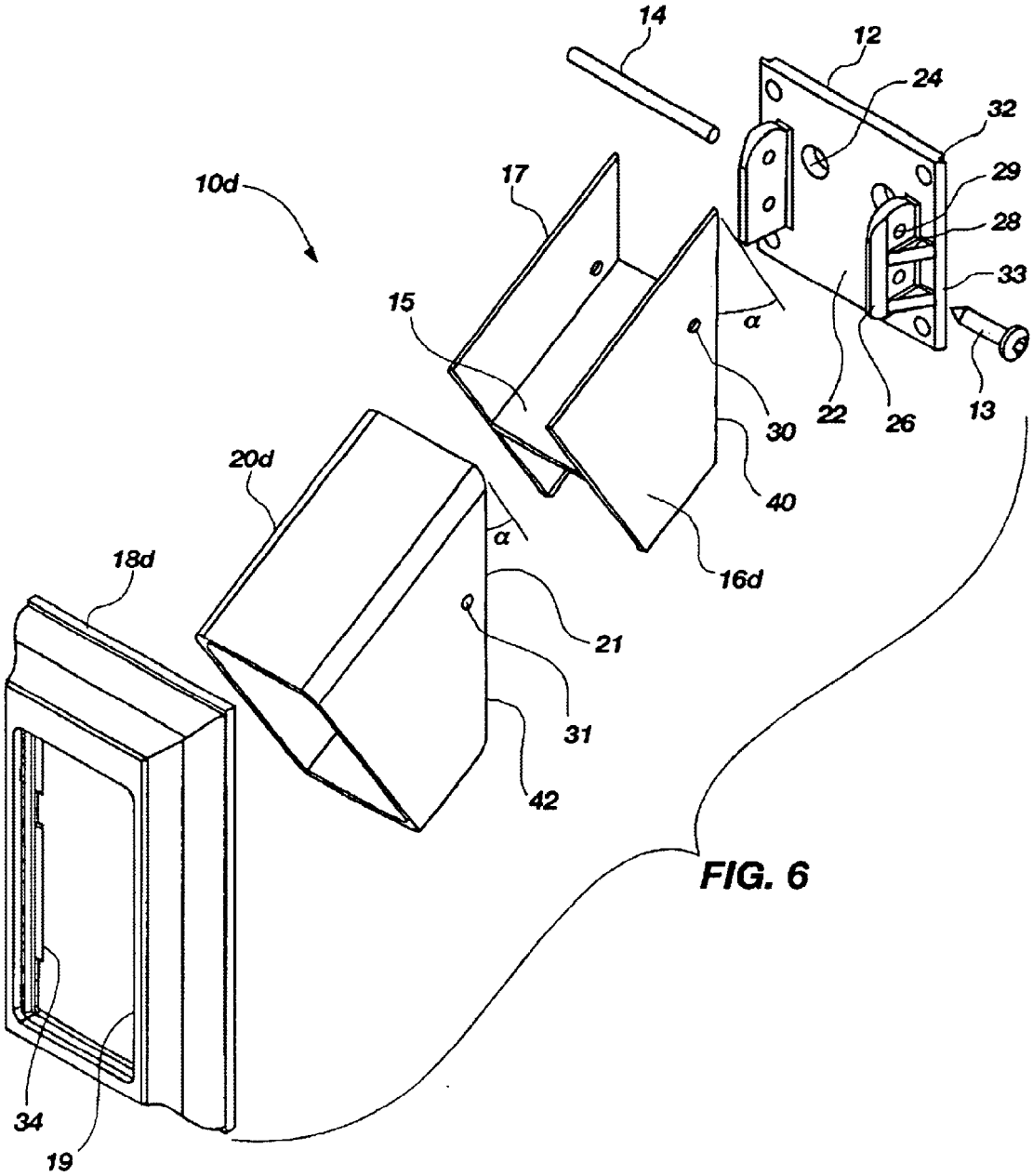
FIG. 6 is an exploded perspective view of a bracket assembly and rail for a stair system.

Referring now to FIG. 6, an exploded perspective view of a bracket assembly 10*d* and rail 20*d* for a stair system is shown. It will be appreciated that the embodiment of the invention illustrated in FIG. 6 contains many of the same structures represented in FIGS. 1–5 and only the new or different structures will be explained to most succinctly explain the additional advantages which come with the embodiment of the invention illustrated in FIG. 6. The embodiment of the invention in FIG. 6 includes an insert 16*d* having an attachment end 40 that may be cut at an angle $\alpha$, whereas the insert 16 disclosed in FIGS. 1–5 may have an attachment end that is perpendicular to the length of the insert 16. Thus, when the attachment end 40 is attached to the base piece 12, the insert 16*d* projects at an angle so that the rail 20*d* may be installed at a corresponding angle along a stair system or other sloped surface. The rail 20*d* may also have a corresponding attachment end 42 that may be cut at an angle $\alpha$ similar to the insert attachment end 40.

Figure 7:
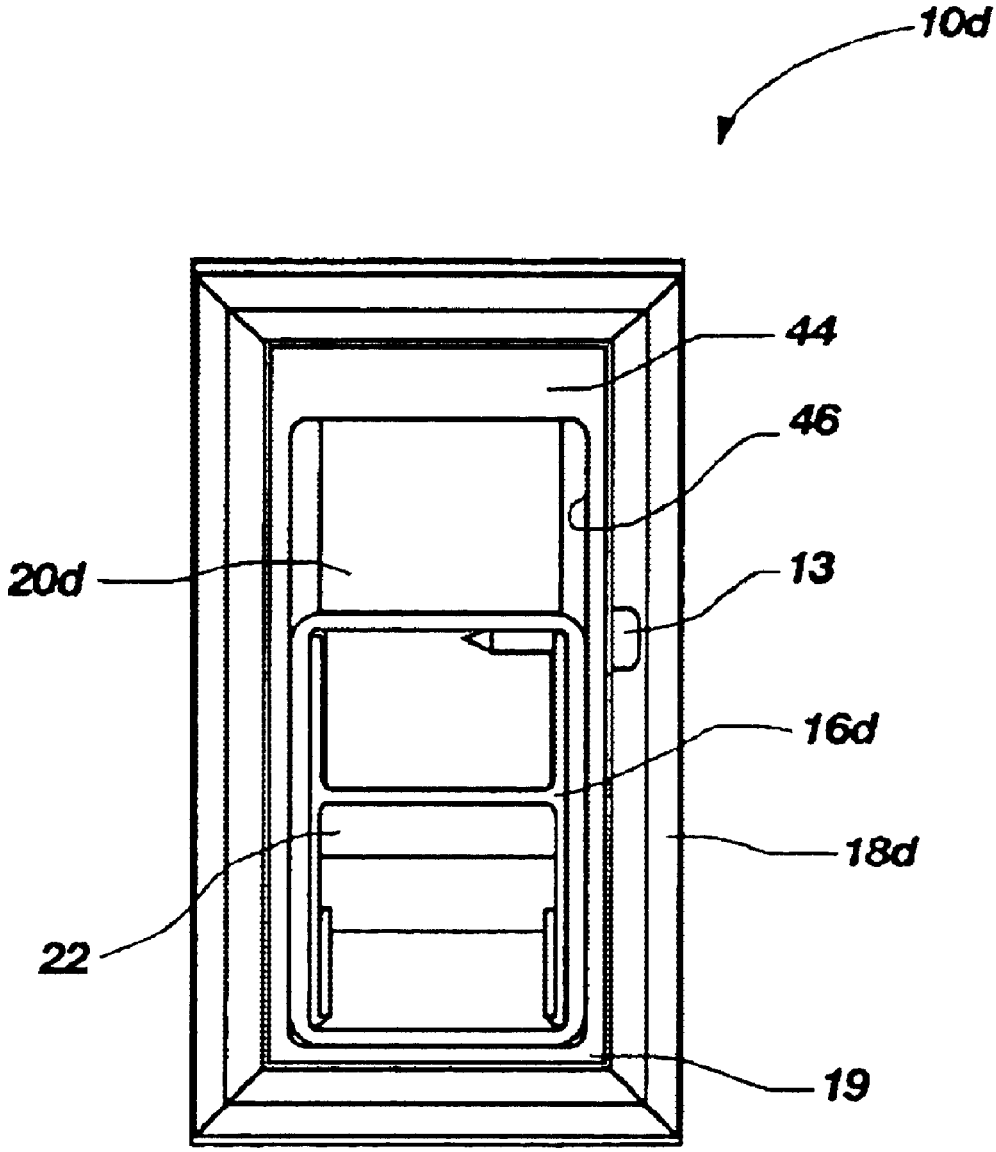
FIG. 7 is an end view of the bracket assembly and rail of FIG. 6.

Referring now to FIG. 7, an end view of the bracket assembly and rail of FIG. 6 is shown. The cover 18*d* may have a perimeter wall 44 defining a rail opening 46. The rail opening 46 may be sized to receive the rail 20*d* at a desired angle $\alpha$, such as thirty-two degrees for example. It will be appreciated that as the angle $\alpha$ increases, the rail opening 46 must be longer, from top to bottom, to accommodate the rail 20*a*. Accordingly, the cover 18*d* for use on stair systems or slopes may be formed longer than the cover 18 for use in other applications.

Figure 8:
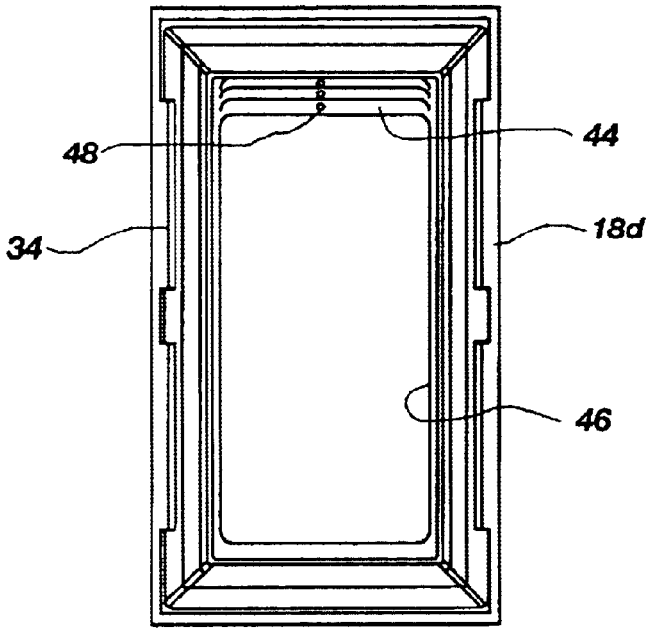
FIG. 8 is a rear plan view of the cover of FIG. 6.

As shown in FIG. 8, indicia 48 may be placed on the back side of the perimeter wall 44 to indicate locations where the perimeter wall 44 may be removed, such as by routing or cutting, to provide a rail opening 46 sized to accommodate the rail 20*d* at a particular angle $\alpha$. It will be appreciated that the indicia 48 may include any variety of visible markings known in the art. The indicia 48 may include lines representing locations where the perimeter wall 44 may be formed corresponding to angles a ranging from twenty to forty-five degrees, for example. However, it will be appreciated that indicia 48 corresponding to any range of angles $\alpha$ may be used within the scope of the present invention.

Figure 9:
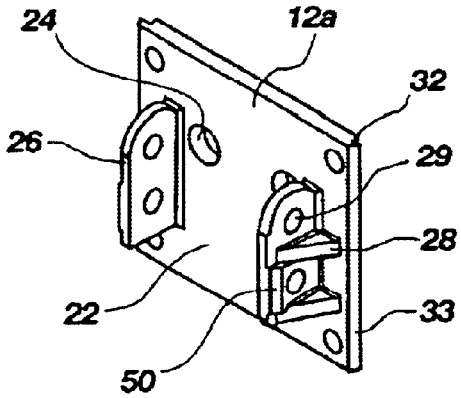
FIG. 9 is an alternate embodiment of the base piece.

Referring now to FIG. 9, an alternative embodiment of the base piece 12*a* is shown. The alternative embodiment base piece 12*a* is similar to the base piece 12 discussed above, except the flange 26 may include a thickened portion 50. The thickened portion 50 may include an area where additional material has been added on the outside of the flange 26 to increase the strength of the flange 26.

It will be appreciated that the structure and apparatus disclosed herein is merely one example of a means for attaching a base piece to a support structure, and it should be appreciated that any structure, apparatus or system for attaching the base piece to the support structure which performs functions the same as, or equivalent to, those disclosed herein are intended to fall within the scope of a means for attaching the base piece to the support structure, including those structures, apparatus or systems for attaching the base piece which are presently known, or which may become available in the future. Anything which functions the same as, or equivalently to, a means for attaching a base piece to a support structure falls within the scope of this element.

In accordance with the features and combinations described above, a useful method of attaching a rail to a support structure includes the steps of:

a) attaching a pair of flanges to the support structure;

b) placing an insert within a hollow open end of the rail for supporting the rail;

c) placing the rail between the flanges; and d) attaching the flanges to the insert.

Those having ordinary skill in the relevant art will appreciate the advantages provided by the features of the present invention. For example, it is a feature of the present invention to provide an improved rail attachment bracket assembly wherein the bracket can be used with rails having different configurations so that the bracket is more versatile and the cost of testing to meet applicable standards is reduced. Another feature of the present invention is to provide such a bracket assembly that is inexpensive and easy to use. It is a further feature of the present invention, in accordance with one aspect thereof, to provide a bracket assembly that can be concealed to provide a finished look to the installed railing.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A bracket assembly for attaching a rail to a support structure, said rail having a hollow open end, said bracket assembly comprising:

a base piece configured for attaching to said support structure, said base piece comprising a plate and a pair of flanges projecting from said plate; and an insert removably attachable to said pair of flanges, said insert comprising opposing sidewalls for supporting said rail;

wherein said insert is configured to fit within said hollow open end of said rail such that rails of various configurations may be attached to said support structure.

2. The bracket assembly of claim 1, wherein said pair of flanges project in a substantially perpendicular orientation with respect to said plate.

3. The bracket assembly of claim 1, wherein said insert comprises a connecting wall positioned between said opposing sidewalls.

4. The bracket assembly of claim 1, wherein said pair of flanges each comprise an aperture for receiving a pin to attach said rail to said pair of flanges.

5. The bracket assembly of claim 1, wherein said base piece further comprises means for attaching the base piece to the support structure.

6. The bracket assembly of claim 5, wherein said means for attaching the base piece to the support structure comprises an opening for receiving a bracket fastener.

7. The bracket assembly of claim 1, wherein said insert is comprised of a substantially "H" shaped member.

8. The bracket assembly of claim 1, further comprising a pin for attaching said insert to said pair of flanges.

9. The bracket assembly of claim 8, wherein said pin has a smooth surface characterized by an absence of threads.

10. The bracket assembly of claim 1, further comprising a cover for concealing said base piece.

11. The bracket assembly of claim 10, wherein said base piece comprises a groove, and said cover comprises a tab for inserting into said groove for attaching said cover to said base piece.

12. The bracket assembly of claim 2, wherein said pair of flanges each comprise at least one support arranged in a plane substantially perpendicular to said flanges and said plate.

13. A bracket assembly for attaching a rail to a support structure, said rail having a hollow open end, said bracket assembly comprising:

at least one flange for being attached to said support structure;

an insert removably attachable to said at least one flange for supporting said rail; and a pin for attaching said insert to said rail and said at least one flange, said pin having a smooth surface characterized by an absence of threads;

wherein said insert is configured to fit within said hollow open end of said rail such that rails of various configurations may be attached to said support structure.

14. The bracket assembly of claim 13, further comprising a plate attached to said at least one flange.

15. The bracket assembly of claim 14, wherein said at least one flange projects in a substantially perpendicular orientation with respect to said plate.

16. The bracket assembly of claim 13, wherein said at least one flange comprises two flanges.

17. The bracket assembly of claim 13, wherein said at least one flange comprises an aperture for receiving said pin.

18. The bracket assembly of claim 14, wherein said plate further comprises means for attaching the plate to the support structure.

19. The bracket assembly of claim 18, wherein said means for attaching the plate to the support structure comprises an opening for receiving a bracket fastener.

20. The bracket assembly of claim 13, wherein said insert comprises a substantially "H" shaped member.

21. The bracket assembly of claim 13, wherein said insert comprises an aperture for receiving said pin.

22. The bracket assembly of claim 13, further comprising a cover for concealing said at least one flange.

23. The bracket assembly of claim 22, further comprising a plate, said plate comprising a groove, and wherein said cover comprises a tab for inserting into said groove for attaching said cover to said plate.

24. The bracket assembly of claim 13, wherein said at least one flange comprises at least one support arranged in a plane substantially perpendicular to said at least one flange.

25. A bracket assembly for attaching a rail to a support structure, said rail having a hollow open end, said bracket assembly comprising:

at least one flange for being attached to said support structure, said at least one flange configured to be positioned outside of said hollow open end;

an insert removably attachable to said at least one flange for supporting said rail, said insert configured to fit inside said hollow open end; and a cover for concealing said at least one flange;

wherein said insert and said at least one flange are configured to receive rails of various configurations.

26. The bracket assembly of claim 25, further comprising a plate attached to said at least one flange.

27. The bracket assembly of claim 26, wherein said at least one flange projects in a substantially perpendicular orientation with respect to said plate.

28. The bracket assembly of claim 25, wherein said at least one flange comprises two flanges.

29. The bracket assembly of claim 25, wherein said at least one flange comprises an aperture for receiving a pin for attaching said insert to said at least one flange.

30. The bracket assembly of claim 26, wherein said plate further comprises means for attaching the plate to the support structure.

31. The bracket assembly of claim 30, wherein said means for attaching the plate to the support structure comprises an opening for receiving a bracket fastener.

32. The bracket assembly of claim 25, wherein said insert comprises a substantially "H" shaped member.

33. The bracket assembly of claim 25, wherein said insert comprises an aperture for receiving a pin for attaching said insert to said at least one flange.

34. The bracket assembly of claim 25, further comprising a pin for attaching said insert to said at least one flange.

35. The bracket assembly of claim 26, wherein said plate comprises a groove, and wherein said cover comprises a tab for inserting into said groove for attaching said cover to said plate.

36. The bracket assembly of claim 25, wherein said at least one flange comprises at least one support arranged in a plane substantially perpendicular to said at least one flange.

37. A bracket assembly for attaching a rail to a support structure, said rail having a hollow open end, said bracket assembly comprising:

a base piece for attaching to said support structure, said base piece comprising a plate and a pair of opposing flanges projecting from said plate for receiving said rail therebetween;

an insert removably attached to said base piece for being positioned inside said hollow open end;

wherein said bracket assembly defines a space between said flanges and said insert for receiving said rail such that rails of different configurations may be received in said space.

38. The bracket assembly of claim 37, wherein said insert comprises a pair of opposing walls.

39. The bracket assembly of claim 37, wherein said flanges project in a substantially perpendicular orientation with respect to said plate.

40. The bracket assembly of claim 37, wherein said flanges comprise an aperture for receiving a pin for attaching said insert to said flanges.

41. The bracket assembly of claim 37, wherein said base piece further comprises means for attaching the base piece to the support structure.

42. The bracket assembly of claim 41, wherein said means for, attaching the base piece to the support structure comprises an opening for receiving a bracket fastener.

43. The bracket assembly of claim 37, wherein said insert comprises a substantially "H" shaped member.

44. The bracket assembly of claim 37, wherein said insert comprises an aperture for receiving a pin for attaching said insert to said flanges.

45. The bracket assembly of claim 37, further comprising a pin for attaching said insert to said flanges.

46. The bracket assembly of claim 37, further comprising a cover for concealing said base piece.

47. The bracket assembly of claim 46, wherein said base piece comprises a groove, and wherein said cover comprises a tab for inserting into said groove for attaching said cover to said base piece.

48. The bracket assembly of claim 37, wherein said flanges comprise at least one support arranged in a plane substantially perpendicular to said flanges.

49. A bracket assembly for attaching a rail to a support structure, said rail being configured to be supported in a laterally extending orientation with respect to said support structure and having a hollow open end, said bracket assembly comprising:

a base piece configured for attaching to said support structure, said base piece comprising a substantially planar plate and a pair of opposing flanges projecting in a direction substantially perpendicular to said plate;

an insert removably attachable to said pair of flanges for supporting said rail, said insert having a pair of spaced apart opposing side walls separated by a connecting wall to form a substantially H shaped configuration;

a pin for attaching said rail to said insert and said base piece, said pin having a rounded cross-section and a substantially smooth exterior surface characterized by an absence of threads, said pin having a length such that said pin is configured to extend from one of said flanges to the other of said flanges; and a cover for attaching to said base piece to conceal said base piece and said pin when said pin is attached to said base piece, said cover having a shape configured to surround a perimeter of said rail;

wherein said base piece further comprises means for attaching the base piece to the support structure;

wherein said means for attaching the base piece to the support structure comprises at least one opening for receiving a bracket fastener;

wherein said bracket assembly comprises an aperture in each of said flanges and an aperture in each of said sidewalls in said insert for receiving said pin in a sliding engagement such that said pin is configured to pass through said apertures in said flanges and said apertures in said sidewalls in said insert and a pair of apertures in said rail simultaneously to attach said rail to said insert and to said base piece;

wherein said base piece comprises a groove positioned on said base piece so as to face said support structure, and said cover comprises a tab for inserting into said groove for attaching said cover to said base piece;

wherein said pair of flanges comprise at least one support arranged in a plane substantially perpendicular to said pair of flanges and substantially perpendicular to said plate to strengthen said pair of flanges;

wherein said insert is configured to fit within said hollow open end of said rail and said base piece is configured to receive said rail between said pair of flanges such that said rail is interposed between said flanges and said insert; and wherein said insert and said base piece are configured to be used with rails of various configurations.

50. A bracket assembly for attaching a rail to a support structure, said rail having a hollow open end, said bracket assembly comprising:

a base piece configured for attaching to said support structure; and an insert removably attachable to said base piece and insertable within said hollow open end of said rail;

said base piece and said insert forming part of a means for attaching rails of different configurations to the support structure such that said bracket assembly is adapted for use with rails having different cross-sectional shapes.

* * * * *